US006182626B1

(12) United States Patent
Geus et al.

(10) Patent No.: US 6,182,626 B1
(45) Date of Patent: Feb. 6, 2001

(54) LEVER-TYPE CAM FOLLOWER FOR A VALVE DRIVE OF AN INTERNAL COMBUSTION ENGINE

(75) Inventors: Hubert Geus, Kemmern; Steffen Hertrich, Nürnberg, both of (DE)

(73) Assignee: INA Wälzlager Schaeffler oHG, Herzogenaurach (DE)

( * ) Notice: Under 35 U.S.C. 154(b), the term of this patent shall be extended for 0 days.

(21) Appl. No.: 09/353,751

(22) Filed: Jul. 14, 1999

(30) Foreign Application Priority Data

Jul. 23, 1998 (DE) ..... 198 33 112

(51) Int. Cl.[7] ..... F01L 1/18
(52) U.S. Cl. ..... 123/90.39
(58) Field of Search ..... 123/90.39, 90.4, 123/90.41, 90.42, 90.44, 90.45, 90.46; 74/519, 559, 569

(56) References Cited

U.S. PATENT DOCUMENTS

| | | | |
|---|---|---|---|
| 1,699,659 | | 1/1929 | Fagan . |
| 2,338,726 | | 1/1944 | Leake . |
| 2,345,822 | | 4/1944 | Leake . |
| 3,289,657 | | 12/1966 | Winter, Jr. . |
| 3,359,959 | | 12/1967 | Rose . |
| 4,614,171 | | 9/1986 | Malhotra . |
| 5,016,582 | | 5/1991 | Mills . |
| 5,678,459 | * | 10/1997 | Motohashi et al. ..... 74/559 |
| 5,720,245 | * | 2/1998 | Calka ..... 123/90.44 |
| 5,730,093 | * | 3/1998 | Calka et al. ..... 123/90.39 |
| 5,819,694 | * | 10/1998 | Trutescu et al. ..... 123/90.43 |
| 6,035,820 | * | 3/2000 | Engelhardt ..... 123/90.41 |
| 6,062,184 | * | 5/2000 | Engelhardt ..... 123/90.41 |

FOREIGN PATENT DOCUMENTS 195 43 657 A1 5/1997 (DE) .

* cited by examiner

*Primary Examiner*—Teresa Walberg
*Assistant Examiner*—Vinod D. Patel
(74) *Attorney, Agent, or Firm*—Henry M. Feiereisen

(57) ABSTRACT

A lever-type cam follower for a valve drive of an internal combustion engine for operating at least one gas exchange valve, includes a main body exhibiting a substantially U-shaped configuration and comprised of two spaced-apart side walls extending in a longitudinal direction and a cross member interconnecting the side walls. The cross member defines a valve-proximate side which includes a substantially planar bearing surface for receiving a gas exchange valve. In addition, the cross member is provided with a passageway for conduction of lubricant to a contact zone of the gas exchange valve upon the bearing surface, whereby the passageway is disposed outside the contact zone but in immediate proximity thereto.

10 Claims, 2 Drawing Sheets

LEVER-TYPE CAM FOLLOWER FOR A VALVE DRIVE OF AN INTERNAL COMBUSTION ENGINE

CROSS-REFERENCES TO RELATED APPLICATIONS

This application claims the priority of German Patent Application Serial No. 198 33 112.6, filed Jul. 23, 1998, the subject matter of which is incorporated herein by reference.

BACKGROUND OF THE INVENTION

The present invention relates to a lever-type cam follower for a valve drive of an internal combustion engine for operating at least one gas exchange valve.

U.S. Pat. No. 5,016,582, issued May 21, 1991 discloses a cam follower which is of substantially U-shaped cross section and includes two longitudinal side walls which are interconnected by a cross member. The cross member defines a valve-proximate side which has an end portion formed with a bearing surface for a gas exchange valve. An opening is formed through the cross member for passage of lubricant to the contact zone of the gas exchange valve upon the bearing surface. This conventional cam follower suffers the drawback that the bearing surface for the gas exchange valve is formed as a ball-shaped recess that increases the complexity of manufacture. Moreover, the opening for transmission of lubricant is disposed exactly in the contact zone between the gas exchange valve and the bearing surface. Thus, increased wear is experienced in this zone so that the recessed region must be reinforced.

SUMMARY OF THE INVENTION

It is an object of the present invention to provide an improved cam follower, obviating the afore-stated drawbacks.

This object, and others which will become apparent hereinafter, are attained in accordance with the present invention by providing a main body exhibiting a substantially U-shaped configuration and comprised of two spaced-apart side walls, extending in a longitudinal direction, and a cross member interconnecting the side walls and having a valve-proximate side which includes a substantially planar bearing surface for receiving a gas exchange valve, whereby a passageway is formed through the cross member for conduction of lubricant to a contact zone between the gas exchange valve and the bearing surface, with the passageway being disposed outside the contact zone but in immediate proximity thereto.

Through the configuration of the cross member with a substantially planar bearing surface and disposition of the passage way outside the contact zone between the gas exchange valve and the bearing surface but yet immediately adjacent thereto, a superior lubrication of the contact zone is realized, while wear, as discussed above, is no longer a factor in this contact zone. Furthermore, the cam follower according to the invention is of simple structure and therefore easy to manufacture.

According to another feature of the present invention, two side bars extend from an end face of the cam follower to effect a simple lateral guidance of the gas exchange valve. The side bars may be made, for example, through punching and bending. Suitably, the passageway for transmitting lubricant to the contact zone of the gas exchange valve upon the bearing surface is provided by an opening in the area of at least one of the side bars whereby the opening at least partially intersects in prolongation the side bar outside the immediate contact zone.

Each side bar may have a substantially arched configuration on the valve-proximate side of the cross member and defines an end which approaches the valve-proximate side. Alternatively, each side bar may also abut the valve-proximate side of the cross member, whereby the opening forming the passageway also intersects in prolongation the side bar and is fluidly connected via a recess, provided in the side bar or valve-proximate side of the cross member for transmitting lubricant into the direction toward the contact zone to realize an appropriate lubrication in this region.

The valve-proximate side of the cross member may be so positioned as to face away from the side walls of the main body. However, it is certainly within the scope of the present invention to position the valve-proximate side between the side walls, as well.

For reasons of cost-efficiency, the cam follower may be made of sheet steel. However, other material may also be used, such as lightweight materials, plastic materials, etc. The cam follower may also be made through other shaping processes such as casting.

According to still another feature of the present invention, the lubricating opening may be formed as bore which may have a chamfer at the valve-proximate side. The chamfer serves as "collection funnel" for oil spray (lubricant) in the area of the cylinder head, or as small lubricant reservoir. Although the provision of one opening is sufficient, it may be suitable to provide two opening for each contact zone between a gas exchange valve and the bearing surface. The passageway may also be configured as oblong hole or the like, thereby realizing a particularly great amount of lubricant being transmitted.

The cam follower may be made as rocker lever or finger lever, and may be configured for operation of several gas exchange valves acting in a same fashion.

BRIEF DESCRIPTION OF THE DRAWING

The above and other objects, features and advantages of the present invention will now be described in more detail with reference to the accompanying drawing, in which.

DETAILED DESCRIPTION OF PREFERRED EMBODIMENTS

Figure 1:
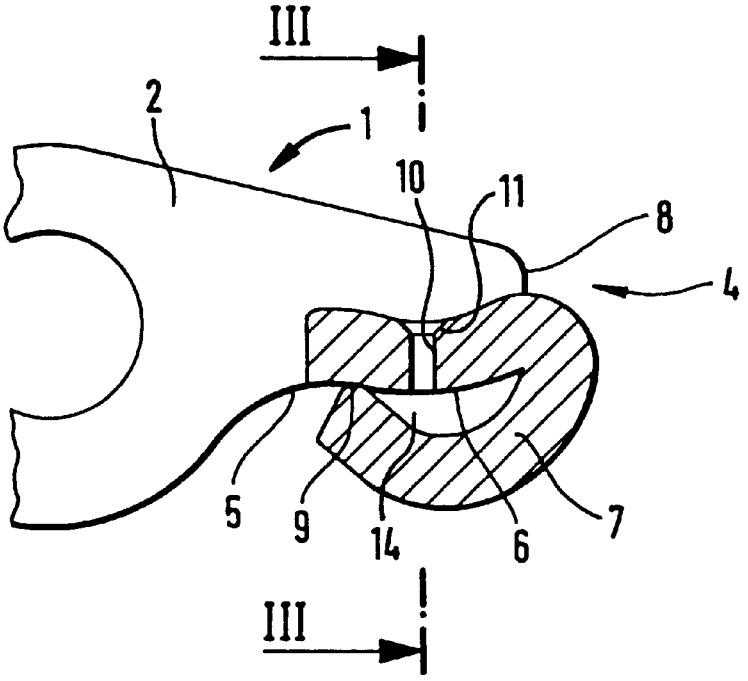
FIG. 1 is a fragmentary sectional view of a cam follower according to the present invention, taken along the line I—I in FIG. 2.

Throughout all the Figures, same or corresponding elements are generally indicated by same reference numerals.

Figure 3:
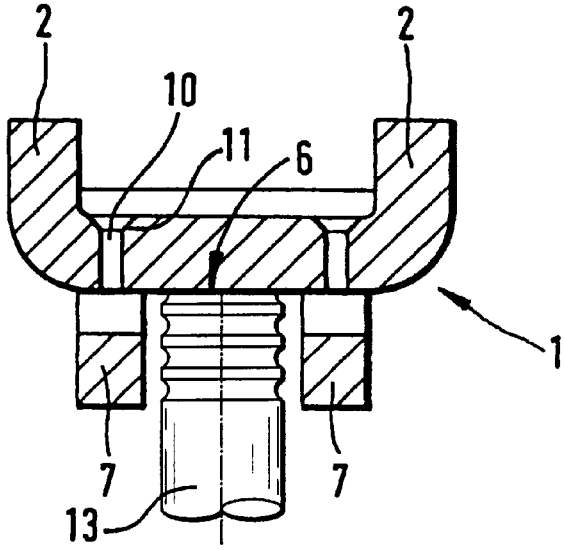
FIG. 3 is a cross section of the cam follower, taken along the line III—III of FIG. 1.

Turning now to the drawing, and in particular to FIG. 1, there is shown a fragmentary sectional view of a cam follower according to the present invention, for actuation of a gas exchange valve 13 (indicated partially in FIG. 3). Operation of cam followers is generally known so that a further detailed description thereof is omitted for sake of simplicity.

The cam follower 1 has a main body, generally designated by reference numeral 1 and including two longitudinal side walls 2 in spaced-apart parallel disposition, and a cross member 3 which interconnects the side walls 2. The main body 1 exhibits thus a substantially U-shaped profile which opens in valve-distal direction.

The cross member 3 has one end 4 which defines a valve-proximate side 5 including a substantially planar bearing surface 6 for receiving the gas exchange valve 13. The bearing surface 6 is laterally bounded by side bars 7 for guiding the gas exchange valve. The side bars 7 extend out from an end face 8 of the main body 1 at the vale-proximate side 5 of the cross member 3 and are returned backwards in an arched configuration, with only their ends 9 abutting the valve-proximate side 5 of the cross member 3, thereby demarcating a space 14. An opening 10 extends in the area of each side bar 7 orthogonally through the cross member 3, as can be seen in FIG. 3.

Figure 2:
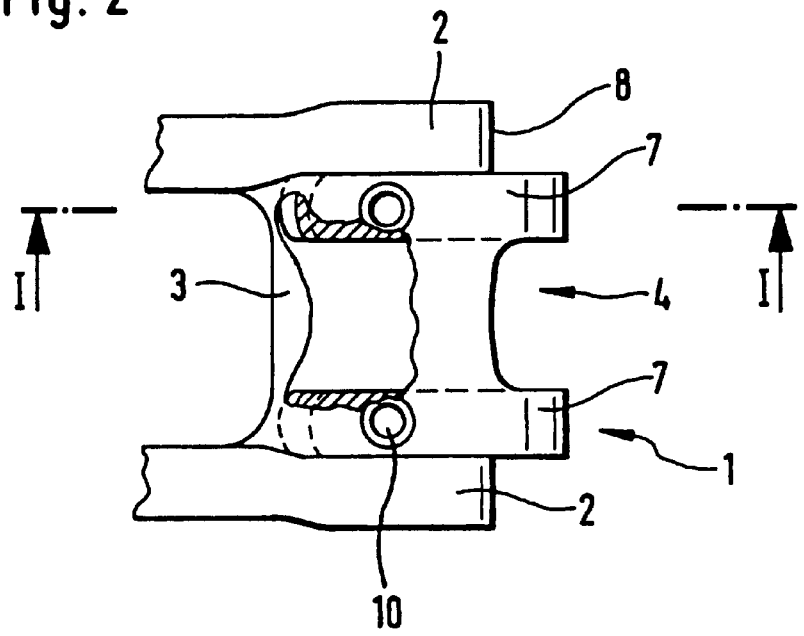
FIG. 2 a plan view of the cam follower of FIG. 1.
Figure 5:
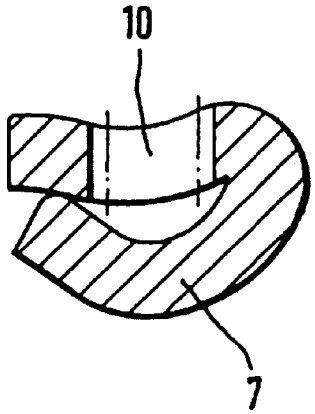
FIG. 5 is a sectional view, similar to FIG. 1, of a modified cam follower, showing only a variation of a side bar.

Turning now to FIG. 2, there is shown that each opening 10 is formed as bore intersecting in prolongation the side bar 7 and having one valve-proximal end which is fluidly connected to the space 14 to allow flow of lubricant to the contact zone between the gas exchange valve 13 and the bearing surface 6. The other valve-distal end of the opening 10 is extended by a chamfer 11, thereby forming a funnel-shaped configuration in which lubricant can accumulate. It will be appreciated by persons skilled in the art that other configurations are possible, such as, for example, trough-shaped recesses or counterbores. As shown in FIG. 5, it is also possible to form the openings 10 as oblong holes.

As shown in FIG. 3, two openings 10 are formed through the cross member 3 in the area of the side bars 7, whereby the openings 10 are so positioned that they do not, or, if at all, only to a very limited extent, project into a contact zone between the gas exchange valve 13 and the bearing surface 6. Lubricant is conducted through the openings 10 to the contact zone so that only little wear is encountered. At the same time, the gas exchange valve 13 is in full contact with the bearing surface 6.

Figure 4:
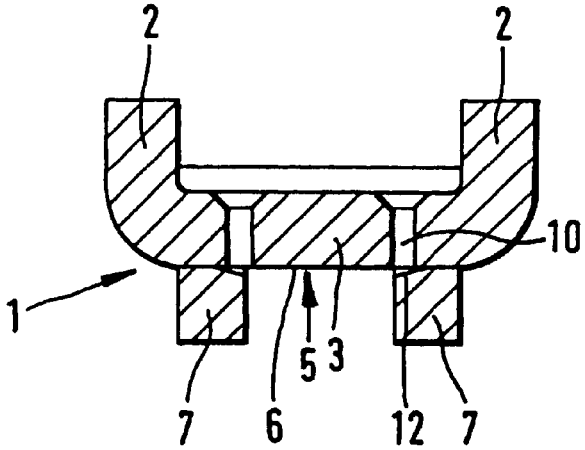
FIG. 4 is a cross section of a modified cam follower, similar to FIG. 3.

Turning now to FIG. 4, there is shown a cross section of a modified cam follower, with the difference to the previous embodiment residing in the configuration of the side bars 7. As shown in FIG. 4, the side bars 7 extend backwards such as to abut the valve-proximate side 5 of the cross member 3. In order to realize a transmission of fluid from the openings 10 to the contact zone between the gas exchange valve 13 and the bearing surface 6, without requiring a disposition of the openings 10 in the contact zone, the side bars 7 are each formed on their inside in the area of the valve-proximate side 5 of the cross member 3 with a recess 12 via which lubricant can unimpededly flow in direction to the bearing surface 6.

While the invention has been illustrated and described as embodied in a lever-type cam follower for a valve drive of an internal combustion engine, it is not intended to be limited to the details shown since various modifications and structural changes may be made without departing in any way from the spirit of the present invention.

What is claimed as new and desired to be protected by Letters Patent is set forth in the appended claims:

1. A lever-type cam follower for a valve drive of an internal combustion engine for operating at least one gas exchange valve, said cam follower comprising a main body exhibiting a substantially U-shaped configuration and comprised of two spaced-apart side walls extending in a longitudinal direction and a cross member interconnecting the side walls and having a valve-proximate side which includes a substantially planar bearing surface for receiving a gas exchange valve, said cross member being provided with passageway means for conduction of lubricant to a contact zone of the gas exchange valve upon the bearing surface, said passageway means being disposed outside the contact zone but in immediate proximity thereto.

2. The cam follower of claim 1 wherein the main body defines a longitudinal center plane and has an end face, said main body including two side bars in spaced-apart disposition relative to the center plane for guiding the gas exchange valve, said side bars extending on the valve-proximate side of the cross member.

3. The cam follower of claim 2 wherein the side bars are spaced from the center plane at same distances.

4. The cam follower of claim 2 wherein the side bars have a substantially arched configuration on the valve-proximate side and define ends which approach the valve-proximate side, said passageway means including an opening which so extends in an area of a side bar as to intersect in prolongation the side bar.

5. The cam follower of claim 4 wherein the opening is formed as a bore or as an oblong hole, said opening having a valve-distal side formed with a chamfer.

6. The cam follower of claim 2 wherein the side bars substantially abut the valve-proximate side of the cross member, said passageway means including an opening which so extends in an area of a side bar as to intersect in prolongation the side bar, wherein one element of the group comprising said side bar and said valve-proximate side of the cross member is provided with a recess fluidly communicating with the opening and pointing in a direction toward the bearing surface.

7. The cam follower of claim 6 wherein the opening is formed as a bore or as an oblong hole, said opening having a valve-distal side formed with a chamfer.

8. The cam follower of claim 1 wherein the valve-proximate side of the cross member faces away from the side walls.

9. The cam follower of claim 1 wherein the main body is made of sheet steel.

10. The cam follower of claim 1 wherein the cam follower is designed as rocker lever or finger lever.

* * * * *